US009868136B2

(12) United States Patent
Soya et al.

(10) Patent No.: US 9,868,136 B2
(45) Date of Patent: Jan. 16, 2018

(54) DEVICE FOR PRODUCING COATED STEEL SHEET AND METHOD FOR PRODUCING COATED STEEL SHEET

(75) Inventors: Katsuhide Soya, Tokyo (JP); Masayoshi Nagatomi, Tokyo (JP); Fumio Shibao, Tokyo (JP); Hiroyasu Furukawa, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days.

(21) Appl. No.: 14/238,535

(22) PCT Filed: Mar. 14, 2012

(86) PCT No.: PCT/JP2012/056560
§ 371 (c)(1),
(2), (4) Date: Feb. 12, 2014

(87) PCT Pub. No.: WO2013/136468
PCT Pub. Date: Sep. 19, 2013

(65) Prior Publication Data
US 2014/0193588 A1 Jul. 10, 2014

(51) Int. Cl.
*B05C 11/06* (2006.01)
*B05D 7/14* (2006.01)
(Continued)

(52) U.S. Cl.
CPC ..... *B05D 7/14* (2013.01); *B05C 5/005* (2013.01); *B05C 11/06* (2013.01);
(Continued)

(58) Field of Classification Search
CPC ..... B05C 11/06; B05C 11/1039
See application file for complete search history.

(56) References Cited

U.S. PATENT DOCUMENTS 3,678,890 A * 7/1972 Ehrensing et al. ..... 118/63
3,930,464 A * 1/1976 Wallsten ..... 118/122
(Continued)

FOREIGN PATENT DOCUMENTS

DE 199 60 772 A1 6/2001
EP 1 338 344 A2 8/2003
(Continued)

OTHER PUBLICATIONS

English translation of International Preliminary Report on Patentability for PCT/JP2012/056560, dated Sep. 16, 2014, 7 pages.*
(Continued)

*Primary Examiner* — Dah-Wei D Yuan
*Assistant Examiner* — Stephen Kitt
(74) *Attorney, Agent, or Firm* — Birch, Stewart, Kolasch & Birch, LLP

(57) ABSTRACT

A device for producing a coated steel sheet includes: a blowing-off unit which sprays a gas onto and remove an excessive coating that accumulates along a side edge of a steel sheet that threads along one direction; and a coating-collection unit which collects the excessive coating removed by the blowing-off unit. The blowing-off unit includes a spray nozzle and a gas supply member. The coating-collection unit includes a duct and a coating container. In a case where the duct is seen in a plan view, an outlet thereof is disposed to fit in and overlap an inside of an opening of the coating container, and in a case where the duct is seen in a side view, a gap is provided between the outlet and the opening of the coating container.

16 Claims, 7 Drawing Sheets

(51) Int. Cl.

| | |
|---|---|
| ***B05D 1/30*** | (2006.01) |
| ***B05C 5/00*** | (2006.01) |
| ***B05C 11/10*** | (2006.01) |
| ***B05D 3/12*** | (2006.01) |
| ***B05D 3/04*** | (2006.01) |

(52) U.S. Cl.
CPC ..... *B05C 11/1039* (2013.01); *B05D 1/305* (2013.01); *B05D 3/042* (2013.01); *B05D 3/12* (2013.01); *B05D 2202/15* (2013.01)

(56) References Cited

U.S. PATENT DOCUMENTS

| | | | | |
|---|---|---|---|---|
| 4,830,887 | A * | 5/1989 | Reiter | B05C 5/008 118/412 |
| 2003/0161955 | A1 | 8/2003 | Brumwell | |
| 2008/0226828 | A1 * | 9/2008 | Shimizu | D21H 25/16 427/337 |

FOREIGN PATENT DOCUMENTS

| | | | |
|---|---|---|---|
| JP | 7-80378 | A | 3/1995 |
| JP | 7-80394 | A | 3/1995 |
| JP | 7-80395 | A | 3/1995 |
| JP | 7-80396 | A | 3/1995 |
| JP | 8-252502 | A | 10/1996 |
| JP | 8-276150 | A | 10/1996 |
| JP | 2002-273299 | A | 9/2002 |
| JP | 2004-181451 | A | 7/2004 |
| JP | 2006-175826 | A | 7/2006 |
| JP | 2007-44694 | A | 2/2007 |
| JP | 2007-044694 | A * | 2/2007 |
| JP | 2008-526484 | A | 7/2008 |
| JP | 2008-526484 | A * | 7/2008 |
| JP | 2008-221102 | A | 9/2008 |
| JP | 2008-221102 | A * | 9/2008 |
| WO | WO 2006/077277 | A1 | 7/2006 |

OTHER PUBLICATIONS

International Search Report, dated Nov. 27, 2012, issued in PCT/JP2012/056560.

Written Opinion of the International Searching Authority, dated Nov. 27, 2012, issued in PCT/JP2012/056560.

Chinese Office Action, dated Oct. 10, 2014, issued in Application No. 201280041745.1.

* cited by examiner

DEVICE FOR PRODUCING COATED STEEL SHEET AND METHOD FOR PRODUCING COATED STEEL SHEET

TECHNICAL FIELD OF THE INVENTION

The present invention relates to a device for producing a coated steel sheet and a method for producing a coated steel sheet capable of reliably solving a problem caused by excessive coating which accumulates along a side edge of a steel sheet.

RELATED ART

Recently, due to the expansion of usages, a coated steel sheet has been required to have further improvements in quality and characteristics, for example, a uniform thickness of a coating film, improvements in surface glossiness and surface smoothness, stacking and compounding of coating films, and thinning and thickening of coating films.

For example, in Patent Document 1, for the purpose of rectifying air current in the atmosphere, a technique of discharging gas into the atmosphere to prevent coating that falls in a curtain shape from shaking and uniformize the film thickness of a coating film is disclosed. In Patent Document 2, a technique of discharging gas into an object to be coated so as to remove a thick coating generated immediately after starting the application of the coating and achieve a uniform thickness overall is disclosed.

However, it is apparent from the technical configuration that the technique disclosed in Patent Document 1 has an effect only in a case where the falling coating has a small flow rate and a low flow velocity, or the falling coating has a low viscosity. In addition, in Patent Document 2, as described in the examples thereof, only a case where the discharge flow rate of gas is a small flow rate of about 10 $m^3/h$ and a low-viscosity coating having a viscosity of 10 cP (centipoise) is used is postulated. These techniques cannot cope with the thickening of a coating film using a high-viscosity coating and the like among the above-mentioned characteristics that require further improvements.

On the other hand, in Patent Documents 3 to 9, techniques of stacking and applying coatings using a multilayer curtain coater are disclosed. The multilayer curtain coater forms a multilayer coating film without contact, and thus has characteristics in that surface defects such as roping of a coating film, which occurs in a case of using a roll coater, do not occur.

However, the stacking of coating films according to a wet-on-wet method including the multilayer curtain coater and the roll coater has a problem in that coatings are mixed with each other and locally form a mixed layer and thus external appearance failure such as stripe patterns is likely to occur. That is, although the techniques in the related art cope with the stacking of coating films among the above-mentioned characteristics that require further improvements, there are still problems.

PRIOR ART DOCUMENT

Patent Document

[Patent Document 1] Japanese Unexamined Patent Application, First Publication No. 2004-181451

[Patent Document 2] Japanese Unexamined Patent Application, First Publication No. 2002-273299

[Patent Document 3] Japanese Unexamined Patent Application, First Publication No. H07-080378

[Patent Document 4] Japanese Unexamined Patent Application, First Publication No. H07-080394

[Patent Document 5] Japanese Unexamined Patent Application, First Publication No. H07-080395

[Patent Document 6] Japanese Unexamined Patent Application, First Publication No. H07-080396

[Patent Document 7] Japanese Unexamined Patent Application, First Publication No. H08-252502

[Patent Document 8] Japanese Unexamined Patent Application, First Publication No. H08-276150

[Patent Document 9] Japanese Unexamined Patent Application, First Publication No. 2006-175826

SUMMARY OF THE INVENTION

Problems to be Solved by the Invention

The present inventors have paid attention to a possibility that the above problems may be solved by using a high-viscosity coating having a viscosity of 700 mPa·sec (700 cP) or higher and 2000 mPa·sec (2000 cP) or lower. That is, by using the high-viscosity coating, the thickening of a coating film can be achieved to a higher degree than that of the related art, and even in a case where the coating films are stacked by the wet-on-wet method, the coatings can be prevented from being mixed with each other and thus the stacking of the coating films can be achieved.

The present inventors performed various experiments by using the high-viscosity coating, and as a result, it was confirmed that the above-described effects can be obtained. However, when the high-viscosity coating was used, it became apparent that there is a problem in that after applying a coating to a steel sheet, a coating film protrusion in which excessive coating accumulates is formed at side edge of the steel sheet in the sheet-width direction (which are the ends of the steel sheet in the sheet-width direction and are parts of the steel sheet along the longitudinal direction).

FIG. 6 is a perspective view illustrating a device for producing a coated steel sheet, which coats a steel sheet using a coating curtain, according to the related art. As illustrated in FIG. 6, a coating 3 which stays between an applicator roll 1 that rotates in an arrow A direction and a doctor roll 2 that rotates in an arrow B direction is scraped by a blade 4 and forms a coating curtain 3*a*. A pair of curtain guides 5 is provided so that the coating curtain 3*a* reaches a coating pan 6 from the blade 4 without contracted flow, and thus the curtain thickness of the coating curtain 3*a* in the sheet-width direction becomes uniform. The coating curtain 3*a* falls onto the surface of a steel sheet 8 which is supported by a support roll 7 and threads in an arrow C direction such that a coating film 9 is formed on the steel sheet 8. In addition, the coating pan 6 which is provided below the steel sheet 8 accommodates the coating 3 which is not used for coating the steel sheet 8.

FIG. 7 is a longitudinal sectional view of the steel sheet 8 after the coating film 9 is formed, and is a cross-sectional view taken along the line X-X of FIG. 6. In a case where the coating 3 is a high-viscosity coating having a viscosity of 700 mPa·sec (700 cP) or higher and 2000 mPa·sec (2000 cP) or lower, as illustrated in FIG. 7, the excessive coating 3 accumulates at both side edge 8*x* of the steel sheet 8 in the sheet-width direction (which are ends of the steel sheet 8 in the sheet-width direction and are parts of the steel sheet 8 along the longitudinal direction) such that coating film protrusion 9$x$ in which the coating film 9 protrudes are formed.

When the coating film protrusion 9$x$ is formed on the coated steel sheet, there may be cases where the coated steel sheet cannot be cleanly coiled in a production process and thus production efficiency is reduced. In addition, when the coating film protrusion 9$x$ is formed, there may be cases where the product shipping form of the coated steel sheet such as lot size or shape is also limited.

In order to solve the problems, the coating film protrusion 9$x$ needs to be removed. The present inventors examined various methods of removing the coating film protrusion 9$x$, and as a result, it was proved that a method of blowing off and removing the coating film protrusion 9$x$ by spraying gas is preferable from the viewpoints of product quality, production cost, maintenance of a production device, and the like.

However, when the excessive coating (the coating film protrusion 9$x$) which accumulates on the steel sheet 8 is blown off by the blowing-off method, there is concern that the blown-off coating may scatter and adhere to the steel sheet 8 again. That is, when the blown-off coating is reflected or flows back and adheres to the steel sheet 8 again, there may be cases where external appearance failure on the coated steel sheet which is a product occurs.

That is, although there is a possibility that the above-described problems associated with the thickening of the coating film 9 or the stacking of the coating film 9 may be solved by using the high-viscosity coating 3, there is concern that the coating film protrusion 9$x$ may be formed along the side edge 8$x$ of the steel sheet 8. Although the blowing-off method performed by spraying gas is preferable as the method of removing the coating film protrusion 9$x$, there is concern that a problem in that the blown-off coating returns and adheres to the steel sheet 8 again may newly occur. In order to cope with this, using an aspirator including a fan for gas discharge may be considered. However, the suctioned excessive coating adheres to the fan and thus maintenance is necessary, resulting in a reduction in production efficiency. From this viewpoint, it is difficult to adopt this technique.

For the above-described reasons, in the related art, solving the various problems due to the excessive coating (coating film protrusion 9$x$) that adheres to the side edge 8$x$ of the steel sheet 8 causes another problem in turn, and thus it is difficult to collectively solve all the problems.

The present invention has been made taking the foregoing circumstances into consideration, and an object thereof is to provide a device for producing a coated steel sheet and a method for producing a coated steel sheet capable of removing excessive coating that accumulates along the side edge of a steel sheet and reliably preventing the removed excessive coating from re-adhering to the steel sheet.

Means for Solving the Problem

The gist of the present invention is as follows.

(1) A device for producing a coated steel sheet according to an aspect of the present invention includes: a blowing-off unit which sprays a gas onto and remove an excessive coating that accumulates along a side edge of a steel sheet that threads along one direction; and a coating-collection unit which collects the excessive coating removed by the blowing-off unit. The blowing-off unit includes a spray nozzle which is directed in a direction from an inside to an outside in a sheet-width direction of the steel sheet and directed toward the side edge, and a gas supply member which supplies the gas to the spray nozzle. The coating-collection unit includes a duct having an inlet that receives the excessive coating and an outlet that discharges the received excessive coating, and a coating container having an opening that receives the excessive coating discharged from the outlet. In a case where the duct is seen in a plan view, the outlet is disposed to fit in and overlap an inside of the opening of the coating container, and in a case where the duct is seen in a side view, a gap is provided between the outlet and the opening of the coating container.

(2) In the producing device described in (1), when an angle between an extension line of a center axis line of the spray nozzle and a projection line of the extension line on a surface of the steel sheet is defined as β, an angle between the projection line and a sheet threading direction of the steel sheet in a case where the surface is seen in a facing view is defined as α, and the distance from a tip end of the spray nozzle to a point that intersects a plane including the surface when seen along the extension line is defined as d in units of mm, all the following Expressions A, B, and C may be satisfied, and a discharge direction of the spray nozzle may be disposed to be opposite to the sheet threading direction of the steel sheet.

$$20° \leq \alpha \leq 70° \quad \text{(Expression A)}$$

$$20° \leq \beta \leq 70° \quad \text{(Expression B)}$$

$$10\ \text{mm} \leq d \leq 55\ \text{mm} \quad \text{(Expression C)}$$

(3) In the producing device described in (1) or (2), a size of the gap in a side view may be 60 mm or more and 100 mm or less.

(4) In the producing device described in any one of (1) to (3), a viscosity of the coating applied to the steel sheet may be 700 Mpa·sec or higher and 2000 Mpa·sec or lower.

(5) In the producing device described in any one of (1) to (4), the blowing-off unit may be adjusted so that a discharge flow rate of the gas discharged from the spray nozzle is 12 $m^3$/h or more and 20 $m^3$/h or less, a discharge flow velocity of the gas discharged from the spray nozzle at a position of 5 mm from a tip end of the spray nozzle in a discharge direction when seen along an extension line of a center axis line of the spray nozzle is 420 m/s or more and 520 m/s or less, and a discharge flow velocity of the gas discharged from the spray nozzle at a position of 5 mm from a point where the extension line intersects a plane including a surface of the steel sheet toward the spray nozzle when seen along the extension line of the center axis line of the spray nozzle is 130 m/s or more and 520 m/s or less.

(6) In the producing device described in any one of (1) to (5), the inlet of the duct may be provided with an extension member which receives the excessive coating directed to an outside of the inlet.

(7) In the producing device described in any one of (2) to (6), the spray nozzle may be disposed so that the discharge direction of the gas is along with the sheet threading direction when seen in the plan view.

(8) In the producing device described in any one of (2) to (7), the spray nozzle may be disposed to further satisfy the following Expression D.

$$0.1 \leq \sin\alpha \cdot \cos\beta \leq 0.9 \quad \text{(Expression D)}$$

(9) In the producing device described in any one of (1) to (8), a shape of a discharge port of the spray nozzle in a facing view may be any of a rectangle, a circle, an ellipse, and a flat shape.

(10) A method for producing a coated steel sheet according to another aspect of the present invention includes: blowing off and removing excessive coating that accumulates along a side edge of a steel sheet on which a coating is applied; and receiving and collecting the removed excessive coating by a coating container via a duct having an inlet and an outlet. An internal pressure of the duct is released from a gap between the outlet of the duct and an opening of the coating container.

(11) In the producing method described in (10), a viscosity of the coating applied to the steel sheet may be 700 Mpa·sec or higher and 2000 Mpa·sec or lower.

Effects of the Invention

According to the aspects of the present invention, the excessive coating that accumulates along the side edge of the steel sheet is blown off and removed, the blown-off coating is prevented from being reflected or flowing back and re-adhering to the steel sheet and the blown-off coating can be reliably collected.

As a result, without a reduction in production efficiency or a limitation to the product shipping form, external appearance failure of the coated steel sheet does not occur. Therefore, it is possible to achieve thickening of the coating film to a higher degree than that of the related art, stacking of coating films in which the generation of a mixed layer of coatings is suppressed, and the like.

EMBODIMENTS OF THE INVENTION

Figure 1:
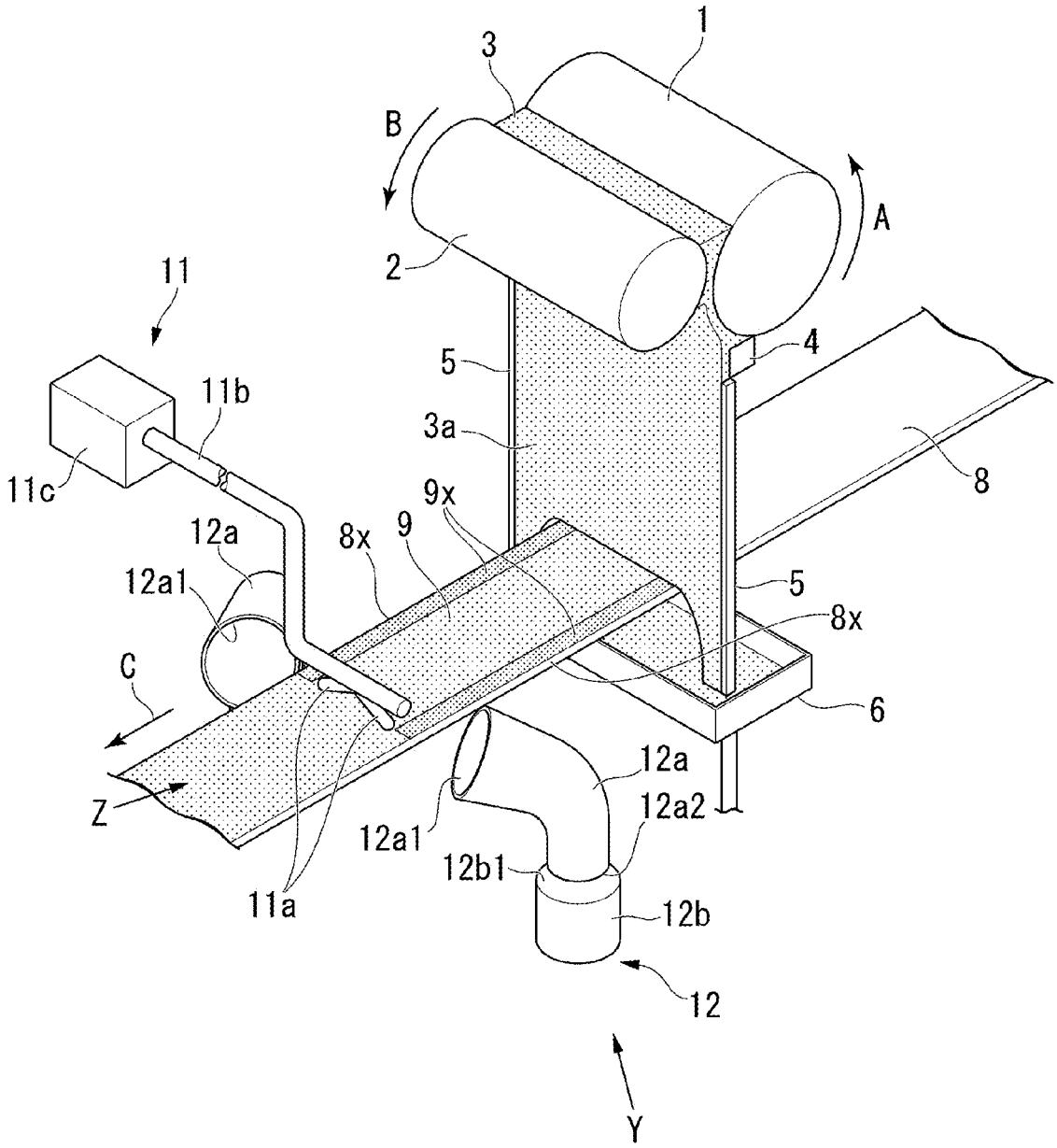
FIG. 1 is a perspective view illustrating a device for producing a coated steel sheet according to an embodiment of the present invention.

A device for producing a coated steel sheet according to an embodiment of the present invention will be described in detail with reference to the drawings. However, the present invention is not limited only to the configuration of the following embodiment, and can be modified in various forms within a range that does not depart from the gist of the present invention. In addition, in the drawings used in the following description, there may be cases where parts which are the main parts are enlarged for convenience to facilitate an understanding of the features of the present invention and the ratio of the dimensions and the like of each constituent element are not limited to be the same as those in practice.

FIG. 1 is a perspective view illustrating the device for producing a coated steel sheet according to this embodiment. As illustrated in FIG. 1, a coating 3 which stays between an applicator roll 1 that rotates in an arrow A direction and a doctor roll 2 that rotates in an arrow 13 direction is scraped by a blade 4 and forms a coating curtain 3*a*. A pair of curtain guides 5 is provided so that the coating curtain 3*a* reaches a coating pan 6 from the blade 4 without contracted flow, and thus the curtain thickness of the coating curtain 3*a* in the width direction becomes uniform. The coating curtain 3*a* falls onto the surface of a steel sheet 8 which threads in an arrow C direction such that a coating film 9 is formed on the steel sheet 8. In addition, the coating pan 6 which is provided below the steel sheet 8 accommodates the coating 3 which is not used for coating the steel sheet 8. In addition, the device for producing a coated steel sheet according to this embodiment includes a blowing-off unit 11 which sprays a gas onto and remove coating film protrusion 9*x* that excessively accumulates along both side edge 8*x* of the steel sheet 8 and a coating-collection unit 12 which collects the coating film protrusion 9*x* that is removed by the blowing-off unit 11.

The blowing-off unit 11 includes spray nozzles 11*a*, a gas supply pipe 11*b*, and a gas supply member 11*c*. Compressed gas is supplied from the gas supply member 11*c* to the spray nozzle 11*a* through the gas supply pipe 11*b*. In addition, the compressed gas is discharged from the spray nozzles 11*a* which are arranged to be directed in directions from the inside to the outside in the sheet-width direction of the steel sheet 8 and in directions from above the steel sheet 8 toward the coating film protrusion 9*x*, thereby blowing off and removing the coating film protrusion 9*x* which is the excessive coating. As a result, in the device for producing a coated steel sheet according to this embodiment, winding of the coated steel sheet in a production process is not impeded, and the product shipping form of the coated steel sheet such as lot size or shape is also not limited.

The coating-collection unit 12 includes a duct 12*a* and a coating container 12*b*. An inlet 12*a*1 of the duct 12*a* is disposed facing a discharge direction of the compressed gas of the spray nozzle 11*a*. In addition, the excessive coating blown off by the blowing-off unit 11 is taken in the inlet 12*a*1 of the duct 12*a*. The excessive coating taken in the duct 12*a* passes through the inside of the duct 12*a* and is discharged from an outlet 12*a*2 of the duct 12*a*.

Figure 2:
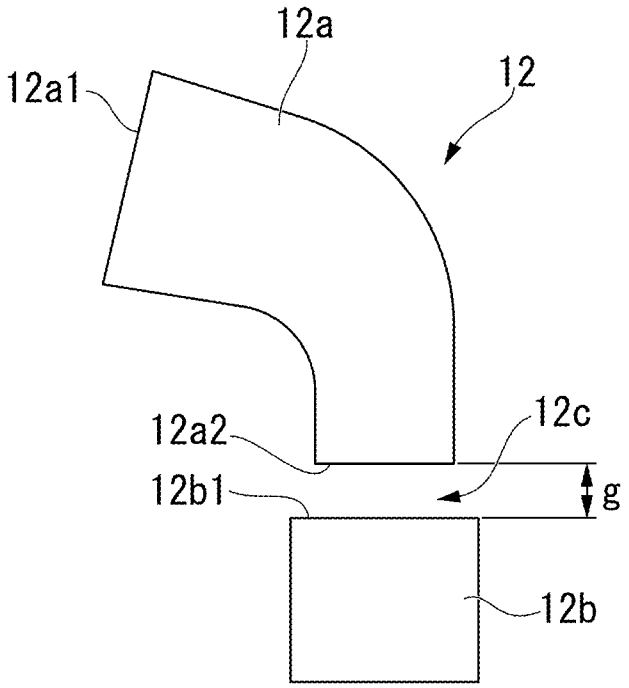
FIG. 2 is a diagram illustrating a coating-collection unit included in the device for producing a coated steel sheet, and is a side view seen in an arrow Y direction of FIG. 1.

In the coating container 12*b*, when the duct 12*a* is seen in a plan view, the outlet 12*a*2 of the duct 12*a* is disposed to coaxially fit in and overlap the inside of an opening 12*b*1 of the coating container 12*b*. As such, it is preferable that the opening 12*b*1 has a larger opening area than the outlet 12*a*2. Accordingly, the taken excessive coating can be collected without leakage. FIG. 2 is a diagram illustrating the coating-collection unit 12 included in the device for producing a coated steel sheet, and is a side view seen in an arrow Y direction of FIG. 1. As illustrated in FIG. 2, a gap 12*c* is provided along a vertical direction between the outlet 12*a*2 of the duct 12*a* and the opening 12*b*1 of the coating container 12*b*.

In the duct 12*a* and the coating container 12*b*, the internal pressure thereof becomes higher than the atmospheric pressure due to the compressed gas discharged from the spray nozzle 11*a*. In this embodiment, the internal pressure is released from the gap 12*c* to the outside of the duct 12*a*, and thus an increase in the internal pressure of the duct 12*a* and the coating container 12*b* is prevented. Accordingly, an air current from the duct 12*a* to the coating container 12*b* and a flow of the excessive coating in the air current become smooth. As a result, the excessive coating taken in the duct 12*a* can be prevented from flowing back and re-adhering to the steel sheet 8. As such, in the device for producing a coated steel sheet according to this embodiment, gas discharge using an aspirator including a fan or the like, which needs maintenance and thus causes a reduction in production efficiency, is not necessary.

In addition, in FIG. 1, as the device for producing a coated steel sheet according to this embodiment, the device for producing a coated steel sheet using the blade type curtain coater is exemplified. However, the present invention is not limited only to the device including the blade type curtain coater as long as the device includes the blowing-off unit 11 and the coating-collection unit 12, and for example, may also be applied to a device for producing a coated steel sheet which adopts a roll coater, a spray coater, a slide curtain coater, a coating method such as dip coating, or the like.

Test 1: Spray-Smoothing Test

Figure 3A:
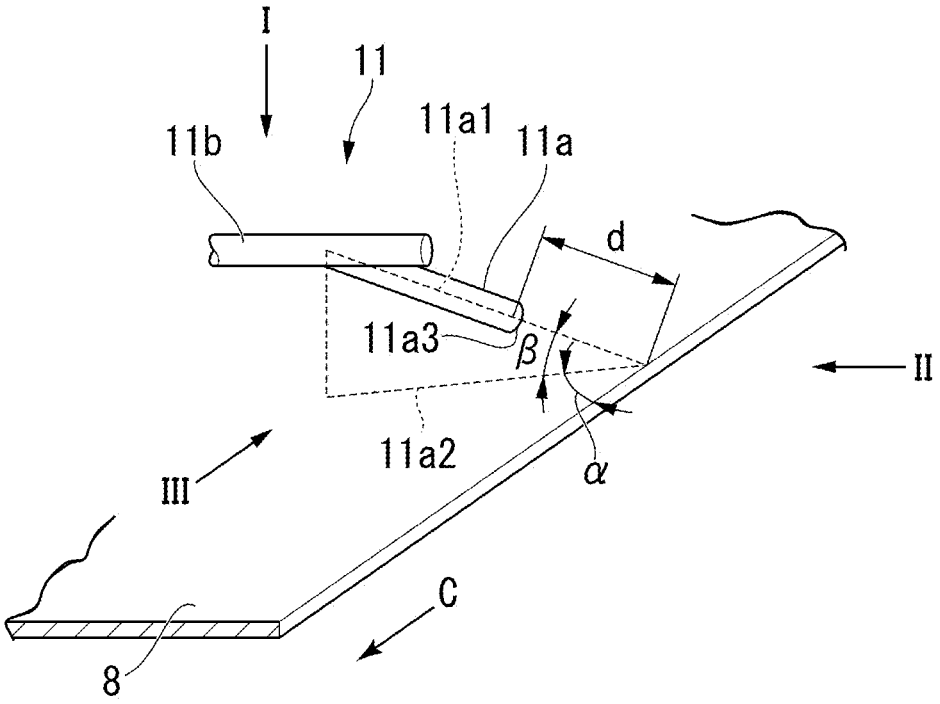
FIG. 3A is a perspective view illustrating the arrangement of a spray nozzle of a blowing-off unit included in the device for producing a coated steel sheet.
Figure 3B:
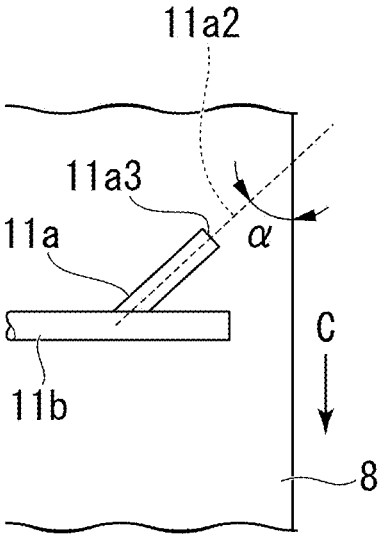
FIG. 3B is a plan view of FIG. 3A seen in an arrow I direction.
Figure 3C:
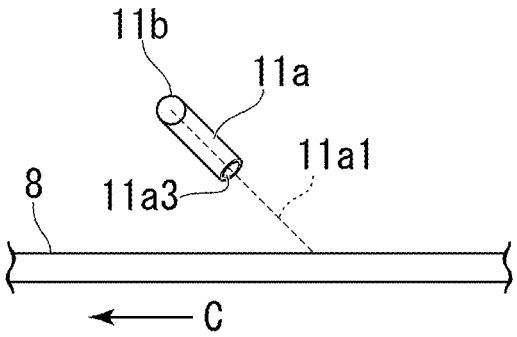
FIG. 3C is a side view of FIG. 3A seen in an arrow II direction.
Figure 3D:
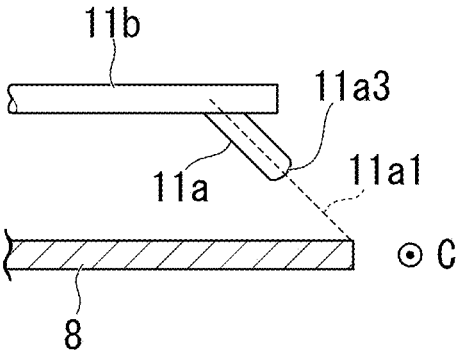
FIG. 3D is a front view of FIG. 3A seen in an arrow III direction.

The present inventors performed a test for smoothing the coating film 9 (spray-smoothing test) by using the high-viscosity coating 3 having a viscosity of 700 Mpa·sec or higher and 2000 Mpa·sec or lower, changing the arrangement condition of the spray nozzle 11*a* in various manners, changing the conditions of the discharge flow velocity and the discharge flow rate of the gas discharged from the spray nozzle 11*a* in various manners, and blowing off the coating film protrusion 9*x* formed at the side edge 8*x* of the steel sheet 8. FIG. 3A is a diagram illustrating the arrangement of the spray nozzle 11*a* of the blowing-off unit 11 included in the device for producing a coated steel sheet, and is a perspective view seen in an arrow Z direction of FIG. 1. FIG. 3B is a plan view of FIG. 3A seen in an arrow I direction. FIG. 3C is a side view of FIG. 3A seen in an arrow II direction. FIG. 3D is a front view of FIG. 3A seen in an arrow III direction.

As illustrated in FIGS. 3A to 3D, the angle between an extension line 11*a*1 of a center axis line of the spray nozzle 11*a* and a projection line 11*a*2 of the extension line 11*a*1 on the surface of the steel sheet 8 is referred to as β in units of degrees °. In addition, in a case where the surface of the steel sheet 8 is seen in a facing view (as illustrated in FIG. 3B, in a case where FIG. 3A is seen in the plan view in the arrow I direction), the angle between the projection line 11*a*2 and a sheet threading direction C of the steel sheet 8 is referred to as α in units of degrees °. Here, an angle α is the angle between the projection line 11*a*2 and the sheet threading direction C of the steel sheet 8 in a case where downstream in the sheet threading direction C is the reference (an angle of 0°). In addition, when seen along the extension line 11*a*1, the distance from a discharge port 11*a*3 which is the tip end of the spray nozzle to a point where the extension line 11*a*1 intersects a plane including the surface of the steel sheet 8 is referred to as d in units of mm. By changing α, β, and d in various manners, the spray-smoothing test was performed. In addition, although not illustrated in FIGS. 3A to 3D, under any conditions, the coating-collection unit 12 was adjusted and arranged so that the inlet 12*a*1 of the duct 12*a* was facing the discharge direction of the compressed gas of the spray nozzle 11*a*.

As a result of the test, the following knowledge was found. In a case where the angle α between the projection line 11*a*2 and the sheet threading direction C of the steel sheet 8, the angle β between the extension line 11*a*1 and the projection line 11*a*2, and the distance d from the discharge port 11*a*3 to the surface of the steel sheet 8 satisfy all the following Expressions A, B, and C, the coating film protrusion 9*x* which is the excessive coating on the steel sheet 8 can be appropriately blown off and removed.

$$20° \leq \alpha \leq 70° \quad \text{(Expression A)}$$

$$20° \leq \beta \leq 70° \quad \text{(Expression B)}$$

$$10\ \text{mm} \leq d \leq 55\ \text{mm} \quad \text{(Expression C)}$$

In a case of α=90°, the gas is sprayed onto the side edge 8*x* of the steel sheet 8 at a right angle (with respect to the sheet threading direction C). In this case, the area of the steel sheet 8 that comes into contact with the gas is minimized, and the amount of the excessive coating being blown off is minimized, which is not preferable. For the same reason, when the angle α exceeds 70°, it is difficult to smooth the coating film 9 after the excessive coating is blown off. In addition, when the angle α is smaller than 20°, it is difficult to blow off the excessive coating, and there is a possibility that the blown-off coating may re-adhere to the steel sheet 8. Therefore, it is preferable that the angle α is 20° to 70°. More preferably, the angle α is 30° to 60°.

In FIGS. 3A to 3D, a case of α<90°, that is, a case where the discharge direction of the spray nozzle 11*a* is substantially opposite to the sheet threading direction C of the steel sheet 8 is illustrated. However, the arrangement of the spray nozzle 11*a* is not limited to the above description, and even in a case of α>90°, that is, even in a case where the spray nozzle 11*a* is arranged so that the discharge direction of the gas from the spray nozzle 11*a* is along with the sheet threading direction C when seen in the plan view, the obtained effect is substantially equal. In this case, it is preferable that the angle α satisfies 110° to 160°. More preferably, the angle α is 120° to 150°. In addition, as described above, the angle α is the angle between the projection line 11*a*2 and the sheet threading direction C of the steel sheet 8 in the case where downstream in the sheet threading direction C is the reference (an angle of 0°).

Similarly, when the angle β is smaller than 20°, it is difficult to blow off the excessive coating. When the angle β exceeds 70°, it is difficult to smooth the coating film 9 after the excessive coating is blown off. Therefore, it is preferable that the angle β is 20° to 70°. More preferably, the angle β is 30° to 60°.

When the distance d exceeds 55 mm, it is difficult to blow off the excessive coating. When the distance d is shorter than 10 mm, it is difficult to smooth the coating film 9 after the excessive coating is blown off. Therefore, it is preferable that the distance d is 10 mm to 55 mm. More preferably, the distance d is 15 mm to 40 mm.

In addition, as a result of the test, the following knowledge was obtained. When α, β, and d associated with the spray nozzle 11*a* satisfy all the above Expressions A, B, and C and also satisfy the following Expression D, the coating film protrusion 9*x* which is the excessive coating formed at the side edge 8*x* of the steel sheet 8 are reliably blown off and thus a flat coating film 9 can be obtained, which is more preferable.

$$0.1 \leq \sin\alpha \cdot \cos\beta \leq 0.9 \quad \text{(Expression D)}$$

The above Expression D is an expression that shows a preferable arrangement of the spray nozzle 11*a*. The upper limit and the lower limit of the Expression D were set on the basis of the result of the spray-smoothing test. More preferably, $0.2 \leq \sin\alpha \cdot \cos\beta \leq 0.8$ is set. Most preferably, $0.4 \leq \sin\alpha \cdot \cos\beta \leq 0.6$ is set.

In FIGS. 3A to 3D, an example in which the intersection between the extension line 11*a*1 of the center axis line of the spray nozzle 11*a* and the steel sheet 8 is on the side edge 8*x* of the steel sheet 8 is illustrated. However, the arrangement of the spray nozzle 11*a* is not limited thereto. As a result of the test, the following knowledge was obtained. It is preferable that the intersection between the extension line 11*a*1 of the center axis line of the spray nozzle 11*a* and the steel sheet 8 is in a range of 0 mm or more and 5 mm or less from the side edge 8*x* of the steel sheet 8 toward the inside in the sheet-width direction. When the intersection between the extension line 11*a*1 of the center axis line of the spray nozzle 11*a* and the steel sheet 8 is shorter than 0 mm (that is, an arrangement in which the intersection is not present on the steel sheet 8), it is difficult to blow off the coating film protrusion 9*x* which is the excessive coating formed at the side edge 8*x* of the steel sheet 8. When the intersection exceeds 5 mm, it is difficult to smooth the coating film 9 after the excessive coating is blown off. More preferably, the intersection between the extension line 11*a*1 of the center axis line of the spray nozzle 11*a* and the steel sheet 8 is 0 mm or more and 3 mm or less.

In addition, as a result of the test, the following knowledge was obtained. In a case where the blowing-off unit is adjusted so that the discharge flow rate of the gas discharged from the spray nozzle 11*a* is 12 $m^3$/h or more and 20 $m^3$/h or less, the discharge flow velocity of the gas discharged from the spray nozzle 11*a* at a position of 5 mm from the discharge port 11*a*3 which is the tip end of the spray nozzle 11*a* in the discharge direction when seen along the extension line 11*a*1 of the center axis line of the spray nozzle 11*a* is 420 m/s or more and 520 m/s or less, and the discharge flow velocity of the gas discharged from the spray nozzle 11*a* at a position of 5 mm from the point where the extension line 11*a*1 intersects the plane including the surface of the steel sheet 8 toward the spray nozzle 11*a* when seen along the extension line 11*a*1 of the center axis line of the spray nozzle 11*a* is 130 m/s or more and 520 m/s or less, the coating film protrusion 9*x* which is the excessive coating formed at the side edge 8*x* of the steel sheet 8 are reliably blown off and thus a flat coating film 9 can be obtained, which is more preferable. In addition, the discharge flow velocity of the gas discharged from the spray nozzle 11*a* may be measured by using a current meter. In addition, the discharge flow rate of the gas discharged from the spray nozzle 11*a* may be measured by using a flowmeter which is not illustrated in the drawings mounted to the spray nozzle 11*a* or may be obtained by a calculation using the measured discharge flow velocity, and the opening area of the discharge port 11*a*3 which is the tip end of the spray nozzle 11*a*.

When the discharge flow rate is less than 12 $m^3$/h, the discharge flow velocity of the gas at the position of 5 mm from the discharge port 11*a*3 in the discharge direction is less than 420 m/s, and the discharge flow velocity of the gas at the position of 5 mm from the intersection between the extension line 11*a*1 and the surface of the steel sheet 8 toward the spray nozzle 11*a* is less than 130 m/s, it is difficult to blow off the excessive coating. In addition, when the discharge flow rate exceeds 20 $m^3$/h, the discharge flow velocity of the gas at the position of 5 mm from the discharge port 11*a*3 in the discharge direction exceeds 520 m/s, and the discharge flow velocity of the gas at the position of 5 mm from the intersection between the extension line 11*a*1 and the surface of the steel sheet 8 toward the spray nozzle 11*a* exceeds 520 m/s, it is difficult to smooth the coating film 9 after the excessive coating is blown off. More preferably, the discharge flow rate is 14 $m^3$/h or more and 16 $m^3$/h or less, the discharge flow velocity of the gas at the position of 5 mm from the discharge port 11*a*3 in the discharge direction is 450 m/s or more and 490 m/s or less, and the discharge flow velocity of the gas at the position of 5 mm from the intersection between the extension line 11*a*1 and the surface of the steel sheet 8 toward the spray nozzle 11*a* is 160 m/s or more and 490 m/s or less. In addition, the discharge flow velocity and the discharge flow rate of the gas may be set to appropriate values in the above ranges according to the values of α, β, and d.

In the spray-smoothing test, the spray nozzle 11*a* of which the shape when the discharge port 11*a*3 of the spray nozzle 11*a* is seen in a facing view is a circle is used. However, the shape of the discharge port 11*a*3 of the spray nozzle 11*a* is not limited to a specific shape as long as the above discharge flow rate or discharge flow velocity can be maintained, and the shape when the discharge port 11*a*3 is seen in the facing view may be any of a circle, a rectangle, an ellipse, and a flat shape.

In addition, in order to ensure a preferable discharge flow rate or discharge flow velocity to blow off the coating film protrusion 9*x* which is the excessive coating, the nozzle pressure of the spray nozzle 11*a* may be set in consideration of α, β, d, and the shape of the discharge port 11*a*3.

In addition, the gas discharged from the spray nozzle 11*a* may be a gas that does not react with the coating 3. Air, inert gases, carbon dioxide, nitrogen gas, and the like are preferable, and in terms of cost, air is more preferable. The gas may be warmed to room temperature or higher. By warming the gas, the viscosity of the coating film 9 on the steel sheet 8 can be reduced, and thus the coating film protrusion 9*x* that is the excessive coating are reliably blown off and a flat coating film 9 can be obtained, which is more preferable. In the case of warming the gas, the gas is preferably warmed to 40° C. or higher.

FIGS. 3A to 3D are enlarged diagrams and illustrate an example in which a single spray nozzle 11*a* is disposed on one side edge 8*x* side of the steel sheet 8. However, two or more spray nozzles 11*a* may be arranged on both of side edge 8*x* sides of the steel sheet 8. For example, by arranging two spray nozzles 11*a* on one side edge 8*x* side of the steel sheet 8, a total of four spray nozzles 11*a* may be arranged on both sides of the side edge 8*x* of the steel sheet 8. In addition, in the case where two or more spray nozzles 11*a* are arranged, flow rate, flow velocity, nozzle pressure, gas type, and the like between the plurality of spray nozzles 11*a* may be the same or may vary as long as the smoothing of the coating film 9 can be achieved by blowing off the coating film protrusion 9*x* which is the excessive coating.

In addition, in the above-described spray-smoothing test, the high-viscosity coating 3 having a viscosity of 700 mPa·sec or higher and 2000 mPa·sec or lower is used. By using the high-viscosity coating 3 having a viscosity of 700 mPa·sec or higher and 2000 mPa·sec or lower, thickening of the coating film 9 can be achieved to a higher degree than that of the related art, and even in a case where the coating films 9 are stacked by the wet-on-wet method, the coatings 3 can be prevented from being mixed with each other and thus stacking of the coating films 9 is possible, which is preferable. Here, stacking of the coating films 9 according to the wet-on-wet method may be performed by, for example, in FIG. 1, installing two or more curtain coaters in series in the sheet threading direction C and forming, on a certain type of coating film, a different type of coating film.

Test 2: Coating Collection Test

The present inventors performed a test for examining a coating collection status (coating collection test) under the same blowing-off conditions as those of the spray-smoothing test while changing the shapes and arrangement conditions of the duct 12*a*, the coating container 12*b*, and the gap 12*c* of the coating-collection unit 12 in various manners.

As a result of the test, the following knowledge was found. When a size g of the gap 12*c* between the outlet 12*a*2 of the duct 12*a* and the opening 12*b*1 of the coating container 12*b*, illustrated in FIG. 2, is 60 mm or more and 100 mm or less, the blown-off excessive coating is appropriately prevented from being reflected or flowing back, and re-adhering to the steel sheet 8, and the blown-off excessive coating can be collected by the coating container 12*b*.

When the size g of the gap 12*c* is smaller than 60 mm, the amount of exhaust air from the gap 12*c* is not sufficient, and the internal pressure of the duct 12*a* and the coating container 12*b* is not released and increases too high. As a result, there is a possibility that the blown-off excessive coating may be reflected or flow back, and re-adhere to the steel sheet 8. When the size g of the gap 12*c* exceeds 100 mm, the interval between the outlet 12*a*2 of the duct 12*a* and the opening 12*b*1 of the coating container 12*b* is too large, and thus there is a possibility that the coating that falls into the opening 12*b*1 from the outlet 12*a*2 may flow along an air current in the atmosphere and may not be collected by the coating container 12*b*. Therefore, it is preferable that the size g of the gap 12*c* is 60 mm or more and 100 mm or less. More preferably, the size g of the gap 12*c* is 70 mm or more and 90 mm or less.

In addition, as a result of the test, the following knowledge was obtained. Assuming that the opening area of the inlet 12*a*1 of the duct 12*a* is Op1 in units of $mm^2$, the opening area of the outlet 12*a*2 of the duct 12*a* is Op2 in units of $mm^2$, and the opening area of the opening 12*b*1 of the coating container 12*b* is Op3 in units of $mm^2$, in a case where Op1 is $1.9\times10^5$ $mm^2$ or more and $6.4\times10^5$ $mm^2$ or less, Op2 is $1.3\times10^5$ $mm^2$ or more and $4.5\times10^5$ $mm^2$ or less, Op3 is $3.9\times10^5$ $mm^2$ or more and $1.4\times10^6$ $mm^2$ or less, and Op3>Op2 and Op1>Op2 are satisfied, the blown-off excessive coating is appropriately prevented from being reflected or flowing back and re-adhering to the steel sheet 8, and the blown-off excessive coating can be collected by the coating container 12*b*.

In a case where the opening area of each of Op1, Op2, and Op3 is smaller than the above range, there is a possibility that the blown-off excessive coating may be reflected or flow back and re-adhere to the steel sheet 8 and the blown-off excessive coating may not be reliably collected. In a case where the opening area of each of Op1, Op2, and Op3 exceeds the above range, the above-described effect is saturated and there is a problem in that the size of the coating-collection unit 12 itself becomes too large.

In addition, in the case of Op1>Op2, an air current in the duct 12*a* is rectified, and thus the blown-off excessive coating can be appropriately prevented from being reflected or flowing back and re-adhering to the steel sheet 8. In the case of Op3>Op2, as described above, the blown-off excessive coating can be reliably collected by the coating container 12*b*. That is, it is preferable that the relationship between Op1, Op2, and Op3 satisfies Op3>Op2 and Op1>Op2.

Figure 4:
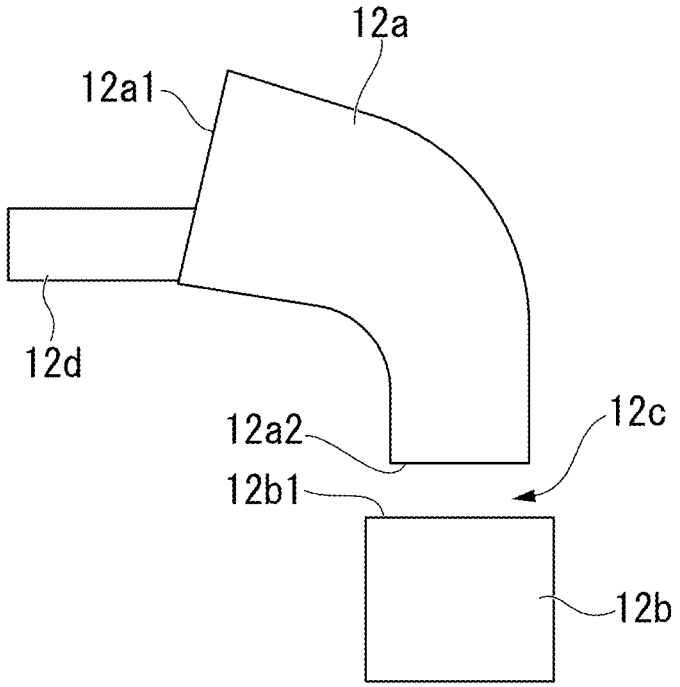
FIG. 4 is a diagram illustrating a modified example in which an extension member is provided in an inlet of a duct of the coating-collection unit and is a side view corresponding to FIG. 2.

In addition, as a result of the test, the following knowledge was obtained. It is preferable that an extension member for receiving the excessive coating that is directed to the outside of the inlet be provided in the inlet 12*a*1 of the duct 12*a*. FIG. 4 is a diagram illustrating a modified example in which the extension member is provided in the inlet 12*a*1 of the duct 12*a* of the coating-collection unit 12 and is a side view corresponding to FIG. 2. As illustrated in FIG. 4, the extension member 12*d* is disposed in the inlet 12*a*1 so as to be directed to the outside of the inlet 12*a*1 of the duct 12*a* and be concealed under the lower surface of the steel sheet 8. By providing the extension member 12*d* in the inlet 12*a*1 of the duct 12*a*, the excessive coating that is blown off the steel sheet 8 by the blowing-off unit 11 can be incorporated into the duct 12*a*.

In the coating collection test described above, the duct 12*a* and the coating container 12*b* in which the shape of each of the openings thereof is a circle are used. However, the shapes of the duct 12*a* and the coating container 12*b* are not limited to the above shape, and the shape of each of the openings thereof when seen in a facing view may be any of a circle, a rectangle, an ellipse, and a flat shape.

In addition, in the coating collection test described above, a single duct 12*a* and a single coating container 12*b* are arranged to be provided for a single spray nozzle 11*a*. However, the arrangement of the duct 12*a* and the coating container 12*b* is not limited thereto, and in a range that satisfies the above-described conditions, for example, an arrangement in which two ducts 12*a* and a single coating container 12*b* are provided for two spray nozzles 11*a* may be adopted.

The device for producing a coated steel sheet of this embodiment described above will be summarized as follows.

(1) The device for producing a coated steel sheet in this embodiment includes: the blowing-off unit 11 which sprays the gas onto and remove the coating film protrusion 9*x* which is excessive coating that accumulates along the side edge 8*x* of the steel sheet 8 that threads along the sheet threading direction C; and the coating-collection unit 12 which collects the excessive coating removed by the blowing-off unit 11. The blowing-off unit 11 includes the spray nozzle 11*a* which is directed in a direction from the inside to the outside in the sheet-width direction of the steel sheet 8 and directed toward the side edge 8*x*, and the gas supply member 11*c* which supplies the gas to the spray nozzle 11*a*. The coating-collection unit 12 includes the duct 12*a* having the inlet 12*a*1 that receives the excessive coating and the outlet 12*a*2 that discharges the received excessive coating, and the coating container 12*b* having the opening 12*b*1 that receives the excessive coating discharged from the outlet 12*a*2. In a case where the duct 12*a* is seen in the plan view, the outlet 12*a*2 is disposed to fit in and overlap the inside of the opening 12*b*1 of the coating container 12*b*, and in a case where the duct 12*a* is seen in a side view, the gap 12*c* is provided between the outlet 12*a*2 and the opening 12*b*1 of the coating container 12*b*.

(2) In addition, when the angle between the extension line II al of the center axis line of the spray nozzle 11*a* and the projection line 11*a*2 of the extension line 11*a*1 on the surface of the steel sheet 8 is β in units of degrees °, the angle between the projection line 11*a*2 and the sheet threading direction C of the steel sheet 8 in a case where the surface is seen in a facing view is α in units of degrees °, and the distance from the discharge port 11*a*3 which is the tip end of the spray nozzle 11*a* to the point that intersects the plane including the surface when seen along the extension line 11*a*1 is d in units of mm, all the following Expressions A, B, and C are satisfied, and the discharge direction of the spray nozzle 11*a* is disposed to be opposite to the sheet threading direction C of the steel sheet 8.

$$20° \leq \alpha \leq 70° \quad \text{(Expression A)}$$

$$20° \leq \beta \leq 70° \quad \text{(Expression B)}$$

$$10 \text{ mm} \leq d \leq 55 \text{ mm} \quad \text{(Expression C)}$$

(3) In addition, the size g of the gap 12*c* in a side view is 60 mm or more and 100 mm or less.

(4) In addition, the viscosity of the coating applied to the steel sheet 8 is 700 Mpa·sec or higher and 2000 Mpa·sec or lower.

(5) In addition, the blowing-off unit is adjusted so that the discharge flow rate of the gas discharged from the spray nozzle 11*a* is 12 $m^3$/h or more and 20 $m^3$/h or less, the discharge flow velocity of the gas discharged from the spray nozzle 11*a* at a position of 5 mm from the tip end of the spray nozzle 11*a* in the discharge direction when seen along the extension line 11*a*1 of the center axis line of the spray nozzle 11*a* is 420 m/s or more and 520 m/s or less, and the discharge flow velocity of the gas discharged from the spray nozzle 11*a* at a position of 5 mm from the point where the extension line 11*a*1 intersects the plane including the surface of the steel sheet 8 toward the spray nozzle 11*a* when seen along the extension line 11*a*1 of the center axis line of the spray nozzle 11*a* is 130 m/s or more and 520 m/s or less.

(6) In addition, the inlet 12*a*1 of the duct 12*a* may be provided with the extension member 12*d* which receives the excessive coating directed to the outside of the inlet 12*a*1.

(7) In addition, the spray nozzle 11*a* is disposed so that the discharge direction of the gas is along with the sheet threading direction C when seen in the plan view and may further satisfy the following Expression E.

$$110° \leq \alpha \leq 160° \quad \text{(Expression E)}$$

(8) In addition, the spray nozzle 11*a* is disposed to further satisfy the following Expression D.

$$0.1 \leq \sin\alpha \cdot \cos\beta \leq 0.9 \quad \text{(Expression D)}$$

(9) In addition, the shape of the discharge port 11*a*3 of the spray nozzle 11*a* in a facing view is a circle. In addition, as described above, as necessary, the shape may be any of a rectangle, a circle, an ellipse, and a flat shape.

Next, a method for producing a coated steel sheet according to an embodiment of the present invention will be described. However, the present invention is not limited to the following embodiment and can be modified in various forms in a range that does not depart from the gist of the present invention.

The method for producing a coated steel sheet according to this embodiment of the present invention includes: a process of blowing off and removing the excessive coating that accumulates along the side edge 8*x* of the steel sheet 8 on which the coating 3 is applied; and a process of receiving and collecting the removed excessive coating by the coating container 12*b* via the duct 12*a* having the inlet 12*a*1 and the outlet 12*a*2. In addition, the internal pressure of the duct 12*a* is released from the gap 12*c* between the outlet 12*a*2 of the duct 12*a* and the opening 12*b*1 of the coating container 12*b*.

By the method for producing a coated steel sheet according to this embodiment described above, the excessive coating that accumulates along the side edge 8*x* of the steel sheet 8 is blown off and removed, the blown-off excessive coating is prevented from being reflected or flowing back and re-adhering to the steel sheet 8, and the blown-off excessive coating can be reliably collected.

In addition, in the method for producing a coated steel sheet according to this embodiment, since the high-viscosity coating 3 in which the viscosity of the coating 3 applied to the steel sheet 8 is 700 Mpa·sec or higher and 2000 Mpa·sec or lower is used, the thickening of the coating film 9 can be achieved to a higher degree than that of the related art, and even in a case where the coating films 9 are stacked by the wet-on-wet method, the coatings can be prevented from being mixed with each other and thus the stacking of the coating films can be achieved.

EXAMPLE 1

Next, Examples of the present invention will be described. However, the conditions of the Examples are only a condition example that is adopted to check a possibility of embodying the present invention and the effect thereof, and the present invention is not limited to the condition examples. The present invention can adopt various conditions as long as the object of the present invention can be achieved without departing from the gist of the present invention.

A high-viscosity coating having a viscosity of 1700 mPa·sec was used, and the coating was applied onto a steel sheet by a blade type curtain coater. After the application, a blowing-off unit and a coating-collection unit arranged under the conditions shown in Table 1 blew off and removed coating film protrusion which is the excessive coating that accumulates on the side edge of the steel sheet under the spray condition shown in Table 1. The results are also shown in Table 1. In addition, in Table 1, the discharge flow velocity of gas in a discharge direction at a position of 5 mm from the tip end of a spray nozzle in the discharge direction when seen along an extension line of a center axis line of the spray nozzle is referred to as a discharge flow velocity 1, and the discharge flow velocity of the gas in the discharge direction at a position of 5 mm from a point where the extension line and the surface of the steel sheet intersect toward the spray nozzle is referred to as a discharge flow velocity 2.

[Table 1]

From Table 1, it is seen that, in Examples 1 to 5, after the coating film protrusion which is the excessive coating is blown off, the film thickness of the coating film at the side edge of the steel sheet is flat.

Figure 5:
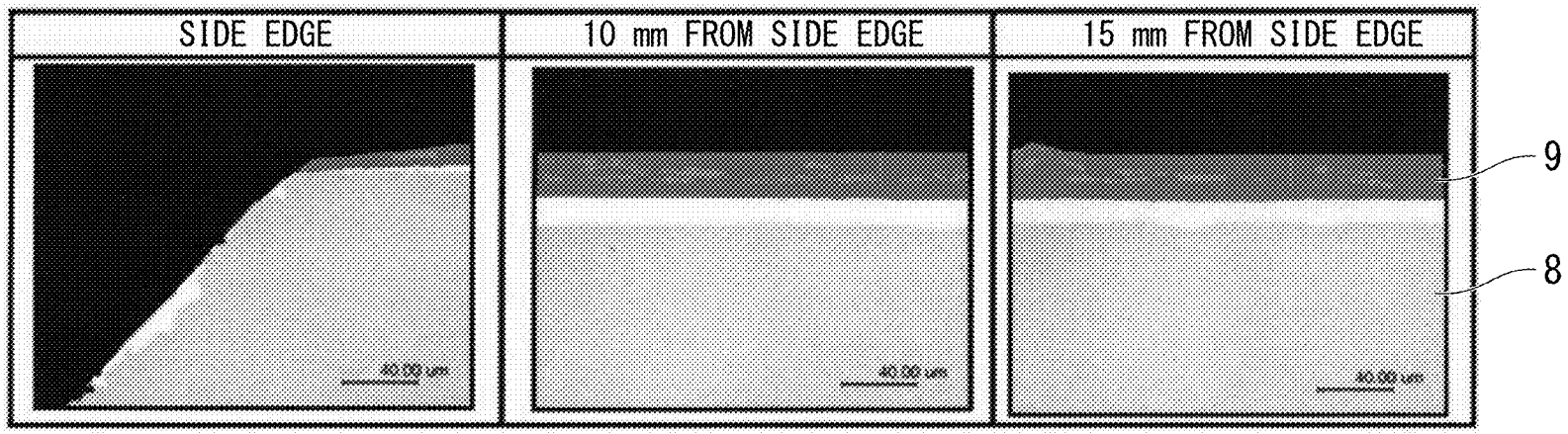
FIG. 5 is a diagram illustrating Example 1 shown in Table 1 and is a photograph of the side edge part of a steel sheet when viewed in a cross section perpendicular to a sheet threading direction thereof.
Figure 6:
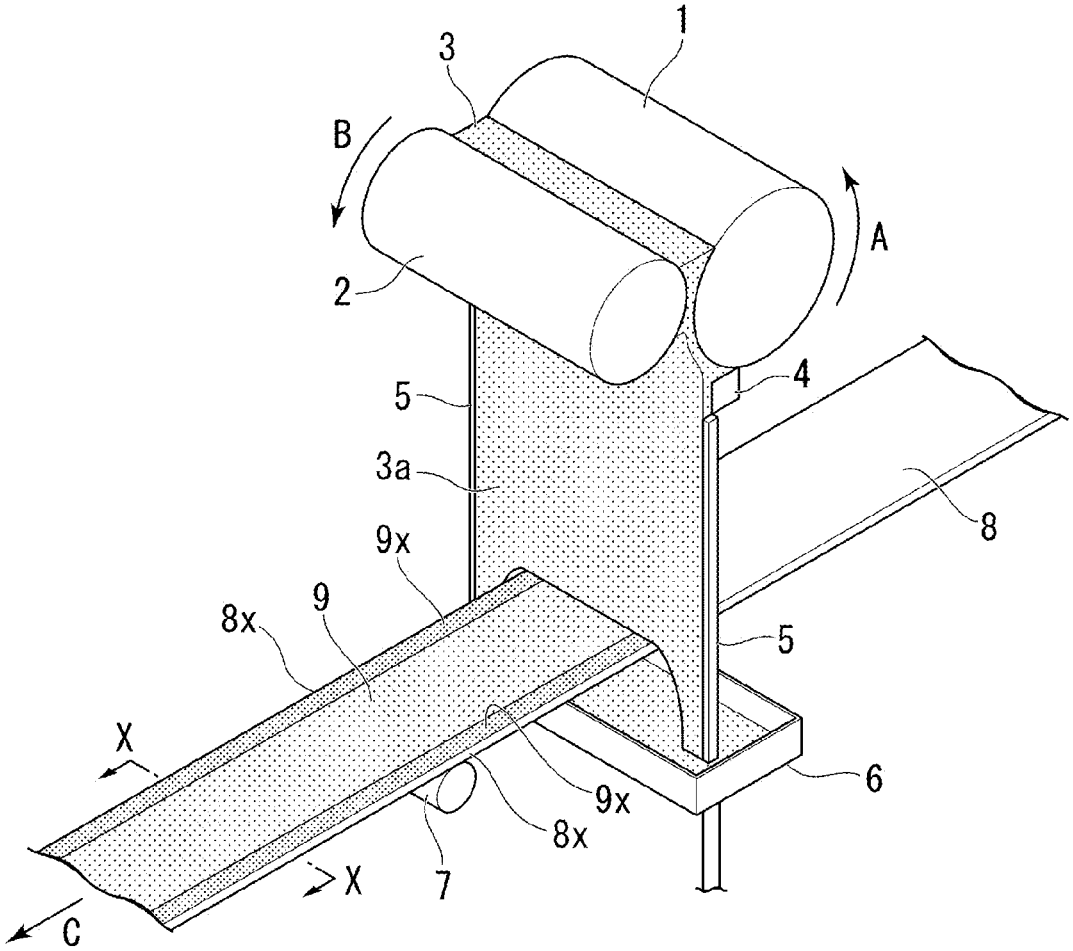
FIG. 6 is a perspective view illustrating a device for producing a coated steel sheet, which coats a steel sheet using a coating curtain, according to the related art.
Figure 7:
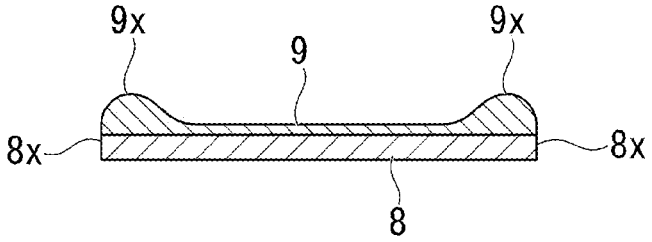
FIG. 7 is a diagram illustrating the steel sheet after a coating film is formed when viewed in a cross section perpendicular to the sheet threading direction thereof, and is a cross-sectional view taken along the line X-X of FIG. 6.

FIG. 5 is a diagram illustrating Example 1 shown in Table 1, is a photograph of the side edge part of the steel sheet when viewed in a cross section perpendicular to the sheet threading direction thereof, and is a cross-sectional photograph taken at positions of 0 mm, 10 mm, and 15 mm from the side edge of the steel sheet toward the inside in the sheet-width direction. This cross-sectional photograph was observed by a scanning electron microscope (SEM). Reference sign 8 denotes the steel sheet and reference sign 9 denotes the coating film in FIG. 5. As shown in FIG. 5, it is seen that in a range of 15 mm from the side edge of the steel sheet toward the inside in the sheet-width direction, the coating film protrusion is removed and thus the film thickness of the coating film is flat.

INDUSTRIAL APPLICABILITY

According to the embodiments of the present invention, the excessive coating that accumulates along the side edge of the steel sheet is blown off and removed, the blown-off coating is prevented from being reflected or flowing back and re-adhering to the steel sheet and the blown-off coating can be reliably collected. As a result, without a reduction in production efficiency or a limitation to the product shipping form, external appearance failure of the coated steel sheet does not occur. Therefore, it is possible to achieve thickening of the coating film to a higher degree than that of the related art, stacking of coating films in which the generation of a mixed layer of coatings is suppressed, and the like, resulting in a high industrial applicability.

REFERENCE SIGNS LIST

1 APPLICATOR ROLL
2 DOCTOR ROLL
3 COATING
3*a* COATING CURTAIN
4 BLADE
5 CURTAIN GUIDE
6 COATING PAN
7 SUPPORT ROLL
8 STEEL SHEET
8*x* SIDE EDGE OF STEEL SHEET
9 COATING FILM
9*x* COATING FILM PROTRUSION (EXCESSIVE COATING)
11 BLOWING-OFF UNIT
11*a* SPRAY NOZZLE
11*b* GAS SUPPLY PIPE
11*c* GAS SUPPLY MEMBER
11*a*1 EXTENSION LINE OF CENTER AXIS LINE OF SPRAY NOZZLE
11*a*2 PROJECTION LINE OF SPRAY NOZZLE
11*a*3 DISCHARGE PORT OF SPRAY NOZZLE
12 COATING-COLLECTION UNIT
12*a* DUCT
12*a*1 INLET OF DUCT
12*a*2 OUTLET OF DUCT
12*b* COATING CONTAINER
12*b*1 OPENING OF COATING CONTAINER
12*c* GAP
12*d* EXTENSION MEMBER
g SIZE OF GAP
A ROTATIONAL DIRECTION OF APPLICATOR ROLL
B ROTATIONAL DIRECTION OF DOCTOR ROLL
C SHEET THREADING DIRECTION OF STEEL SHEET

The invention claimed is:

1. A device for producing a coated steel sheet, comprising:

a blowing-off unit which sprays a gas onto and removes excessive coating that accumulates along a first side edge of a steel sheet that threads along one direction; and a coating-collection unit which collects the excessive coating removed by the blowing-off unit, wherein the blowing-off unit comprises:

a first spray nozzle extending from a gas supply member, the first spray nozzle directed in a direction from an inside to an outside in a sheet-width direction of the steel sheet and directed toward the first side edge, and the gas supply member supplying the compressed gas to the first spray nozzle, wherein the coating-collection unit includes a duct having an inlet that receives the excessive coating and an outlet that discharges the received excessive coating, and a coating container having an opening that receives the excessive coating discharged from the outlet, the container being below the inlet to the duct, wherein, in a case where the duct is seen in a plan view, the outlet is disposed to fit in and overlap an inside of the opening of the coating container, and in a case where the duct is seen in a side view, a gap is provided between the outlet and the opening of the coating container and the gap is 60 mm to 100 mm, wherein an opening area of the inlet of the duct is larger than an opening area of the outlet of the duct, and an opening area of the opening of the coating container is larger than the opening area of the outlet of the duct, wherein the inlet of the duct is located below a surface of the steel sheet and is positioned to be oblique with respect to the surface of the steel sheet and the sheet threading direction of the steel sheet, and the inlet of the duct faces a discharge direction of the compressed gas that is discharged from the first spray nozzle to receive the excessive coating which is blew-off from the surface of the steel sheet, wherein an angle $\beta$ of a center axis of the first spray nozzle and the surface of the steel sheet is between 30 and 60 degrees, wherein an angle $\alpha$ of a projection of the first spray nozzle onto the surface of the steel sheet in a direction perpendicular to the surface of the steel sheet and the first side edge of the steel sheet is between 30 and 60 degrees, wherein a length d along the center axis of the first spray nozzle between an end of the first spray nozzle and the surface of the steel sheet is between 10 mm and 55 mm, and wherein the discharge direction is oblique with respect to all of the sheet threading direction of the steel sheet, a direction perpendicular to the surface of the steel sheet and a width direction of the steel sheet.

2. The device for producing a coated steel sheet according to claim 1, wherein a high-viscosity coating is applied to the steel sheet using a coating curtain and has a viscosity is 700 mPa·sec to 2000 mPa·sec.

3. The device for producing a coated steel sheet according to claim 2, wherein the blowing-off unit is adjusted so that a discharge flow rate of the gas discharged from the first spray nozzle is 12 $m^3$/h or more and 20 $m^3$/h or less, a discharge flow velocity of the gas discharged from the first spray nozzle at a position of 5 mm from a tip end of the first spray nozzle in a discharge direction when seen along an extension line of a center axis line of the first spray nozzle is 420 m/s or more and 520 m/s or less, and a discharge flow velocity of the gas discharged from the first spray nozzle at a position of 5 mm from a point where the extension line intersects a plane including a surface of the steel sheet toward the first spray nozzle when seen along the extension line of the center axis line of the first spray nozzle is 130 m/s or more and 520 m/s or less.

4. The device for producing a coated steel sheet according to claim 2, wherein the inlet of the duct is provided with an extension member which receives the excessive coating directed to an outside of the inlet.

5. The device for producing a coated steel sheet according to claim 2, wherein the first spray nozzle is disposed so that the discharge direction of the gas is along with the sheet threading direction when seen in the plan view.

6. The device for producing a coated steel sheet according to claim 1, wherein the blowing-off unit is adjusted so that a discharge flow rate of the gas discharged from the first spray nozzle is 12 $m^3/h$ or more and 20 $m^3/h$ or less, a discharge flow velocity of the gas discharged from the first spray nozzle at a position of 5 mm from a tip end of the first spray nozzle in a discharge direction when seen along an extension line of a center axis line of the first spray nozzle is 420 m/s or more and 520 m/s or less, and a discharge flow velocity of the gas discharged from the first spray nozzle at a position of 5 mm from a point where the extension line intersects a plane including a surface of the steel sheet toward the first spray nozzle when seen along the extension line of the center axis line of the first spray nozzle is 130 m/s or more and 520 m/s or less.

7. The device for producing a coated steel sheet according to claim 6, wherein the first spray nozzle is disposed so that the discharge direction of the gas is along with the sheet threading direction when seen in the plan view.

8. The device for producing a coated steel sheet according to claim 6, wherein the inlet of the duct is provided with an extension member which receives the excessive coating directed to an outside of the inlet.

9. The device for producing a coated steel sheet according to claim 1, wherein the inlet of the duct is provided with an extension member which receives the excessive coating directed to an outside of the inlet.

10. The device for producing a coated steel sheet according to claim 1, wherein the first spray nozzle is disposed so that the discharge direction of the gas is along with the sheet threading direction when seen in the plan view.

11. The device for producing a coated steel sheet according to claim 1, wherein the first spray nozzle is disposed so as to further satisfy the following Expression 4, $$0.1 \leq \sin\alpha \cdot \cos\beta \leq 0.9 \quad \text{(Expression 4).}$$

12. The device for producing a coated steel sheet according to claim 1, wherein a shape of a discharge port of the first spray nozzle in a facing view is any of a rectangle, a circle, an ellipse, and a flat shape.

13. The device for producing a coated steel sheet according to claim 1, further comprising:

a coating unit which forms a coating curtain by dropping a coating in a vertical direction onto the surface of the steel sheet, wherein the coating unit includes a pair of curtain guides which imparts a constant thickness and a constant width to the coating curtain.

14. The device for producing a coated steel sheet according to claim 1, wherein an extension of the center axis of the first spray nozzle contacts the first side edge of the steel sheet.

15. The device for producing a coated steel sheet according to claim 1, wherein the opening area of the inlet of the duct is $1.9\times10^5$ $mm^2$ to $6.4\times10^5$ $mm^2$, the opening area of the outlet of the duct is $1.3\times10^5$ $mm^2$ to $4.5\times10^5$ $mm^2$, and the opening area of the opening of the coating container is $3.9\times10^5$ $mm^2$ to $1.4\times10^6$ $mm^2$.

16. The device for producing a coated steel sheet according to claim 1, wherein the blowing-off unit removes the excessive coating that accumulates along the first side edge and a second side edge of the steel sheet that threads along one direction, and wherein the blowing-off unit further comprises a second spray nozzle extending from the gas supply member, the second spray nozzle directed in the direction from the inside to the outside in the sheet-width direction of the steel sheet and directed toward the second side edge, and the gas supply member supplies the gas to the first spray nozzle and the second spray nozzle.

* * * * *